US005683303A

United States Patent [19]

Lambourne

[11] Patent Number: 5,683,303

[45] Date of Patent: *Nov. 4, 1997

[54] ELECTRONIC GOLF SCORECARD

[75] Inventor: G. Thomas Lambourne, Calgary, Canada

[73] Assignee: Lambus Enterprises Inc., Calgary, Canada

[ * ] Notice: The term of this patent shall not extend beyond the expiration date of Pat. No. 5,536,010.

[21] Appl. No.: 666,630

[22] Filed: Jun. 18, 1996

Related U.S. Application Data

[63] Continuation of Ser. No. 310,475, Sep. 22, 1994, Pat. No. 5,536,010.

[51] Int. Cl.[6] ..... G06F 16/00

[52] U.S. Cl. ..... 473/131; 340/323 R; 273/460; 273/DIG. 26

[58] Field of Search ..... 473/131, 407, 473/409; 364/410, 411; 377/1, 4–5, 82, 84, 112; 340/323 R; 235/1 B, 61 R, 58 R, 59 R, 61 PK; 273/460, DIG. 26

[56] References Cited

U.S. PATENT DOCUMENTS

| | | | |
|---|---|---|---|
| 3,829,664 | 8/1974 | Kashio . | |
| 4,142,236 | 2/1979 | Martz et al. | 364/411 |
| 4,220,992 | 9/1980 | Blood et al. | 364/410 |
| 4,266,214 | 5/1981 | Peters, Jr. | 340/323 R |
| 4,367,526 | 1/1983 | McGeary et al. | 364/411 |
| 4,864,592 | 9/1989 | Lee | 377/5 |
| 4,910,677 | 3/1990 | Romedio et al. | 364/410 |
| 5,095,430 | 3/1992 | Bonito et al. | 364/410 |
| 5,214,679 | 5/1993 | Metcalf | 377/5 |
| 5,245,537 | 9/1993 | Barber | 364/410 |
| 5,324,028 | 6/1994 | Luna | 273/32 R |
| 5,471,191 | 11/1995 | Narita | 364/411 |
| 5,536,010 | 7/1996 | Lambourne . | |

*Primary Examiner*—Jessica Harrison
*Assistant Examiner*—Mark A. Sager
*Attorney, Agent, or Firm*—Leydig, Voit & Mayer, Ltd.

[57] ABSTRACT

An electronic golf scorecard has a casing which can be opened to expose a keypad and a display. The keypad can be used to enter players' initials, handicap data and each player's score on individual holes during a game of golf. Circuitry within the scorecard, processes and stores the entered data and displays appropriate information so that each player's score can be visually determined. The scorecard keeps a cumulative total of the players' scores after each score entry. When the game of golf has been completed, the net scores for all players are automatically calculated and are displayed by selecting the appropriate key on the keypad. Unused memory locations can be used to keep track of other golfing data such as for example, the number of putts per hole, the holes won or lost during the match or the stroke holes in the match, to name but a few. This other golfing data can be displayed by selecting appropriate keys on the keypad.

14 Claims, 3 Drawing Sheets

10
12
14
16
20
22
30
40
42
50
52
54
56
60
62
64
66
68
70
72
74
80
82
84
86
88
90
92
100
102
104
106
108
HOLE
BLUE
WHITE
MEN'S HD CP
MEN'S PAR
YELLOW
RED
WOMEN'S HD CP
WOMENS PAR
SCORE
FRONT
Power
Handi
Clear

Enter
Name
3
6
9
F/B
2
5
8
Tot/ Net
1
4
7
0
U/L
P1
P2
P3
P4

ELECTRONIC GOLF SCORECARD

This is a continuation of application Ser. No. 08/310,475, filed on Sep. 22, 1994, U.S. Pat. No. 5,536,010.

FIELD OF THE INVENTION

The present invention relates to scorecards and in particular to an electronic scorecard for the game of golf.

BACKGROUND OF THE INVENTION

Electronic scorecards to keep track of the score in a game and in particular the game of golf, are known. For example, U.S. Pat. No. 4,142,236 to Martz et al discloses an electronic scorecard for the game of golf. The scorecard includes a housing on which an array of keys and a display are located. The scorecard can be set to either a program mode Wherein numerical golf course data, such as yardage and par values for the golf course to be played, can be entered via the keys, or a play mode wherein player scoring data can be entered via the keys. A microprocessor in the housing performs selected operations on the entered numerical golf course and player scoring data depending on commands entered via the keys. The results of these operations are then output to the display to allow the results to be visually determined.

U.S. Pat. No. 4,367,526 to McGeary et al discloses a golf calculator including a housing on which an array of keys and a display are located. A player can use the keys to enter numerical golf course data such as yardage and par values, as well as player scoring data, into the calculator. The keys can also be used to designate special contests between individuals or groups of players. A microprocessor in the housing performs operations on the entered numerical golf course and player scoring data depending on commands entered via the keys to calculate individual scores as well as appropriate scores for any designated special contests between players.

Although these prior art electronic golf scorecards exist, improved scorecards to facilitate use and provide enhanced features are desired. It is therefore an object of the present invention to provide a novel electronic scorecard for the game of golf.

SUMMARY OF THE INVENTION

According to one aspect of the present invention them is provided an electronic scorecard for the game of golf to keep score for at least one player comprising:

input means to permit a user to enter golfer scoring data and golfer handicap data, said input means also allowing a user to input selected commands;

a processor responsive to said input means for calculating the gross score of said at least one player for a game of golf based on said entered golfer scoring and for calculating the net score of said at least one player for said game of golf based on said gross score and handicap data;

memory for storing said golfer scoring and handicap data and said gross and net scores; and a display for displaying said golfer scoring data and said gross and net scores.

In one embodiment, the golfer scoring data, the gross score and the net score of the at least one player are displayed in response to selected commands entered via the input means. Also, the at least one player's handicap data is determined from the at least one player's index number and the golf course slope rating.

In this embodiment, it is preferred that the at least one player's scoring data for either the entire front nine or back nine holes of golf is displayed at a time. It is also preferred that the processing means is responsive to input selected commands and toggles the display between a display of the entire front nine or back nine holes of golf. It is also preferred that the at least one player's cumulative score for the displayed nine holes of golf is also displayed.

According to another aspect of the present invention there is provided an electronic scorecard for the game of golf to keep score for at least one player comprising:

input means to permit a user to enter golfer scoring and other golfing data and to input selected commands;

a processor responsive to said input means for calculating the score of said at least one player for a game of golf based on said entered golfer scoring data;

memory for storing said golfer scoring data and other golfer data associated with said at least one player; and a display for displaying said golfer scoring data, said calculated score and said other golfing data.

Preferably, in this aspect, the other golfing data is selected from the group consisting of the number of putts per hole, the number of holes won or lost in a match, the stroke holes in a match, the course handicap rating for each hole, the player with the honor on each hole, the number of greens or fairways hit in regulation, the number of sand shots, the amount of money won or lost on each hole, the presses or new bets made, the par values for each hole, the number of strokes over or under par, the number of lost balls or the number of penalty strokes taken.

The present invention provides advantages in that the scorecard is easy to use and eliminates the need for cumbersome paper scorecard and pencil combinations and therefore, reduces waste. The design of the scorecard is also such that it fits comfortably in a golfer's pocket or golfbag or is readily accommodated by a golfcart. In addition, the present scorecard is weather resistant and is universal, allowing it to be used on golf courses around the world. Furthermore, the present scorecard calculates both gross and net scores for one or more players and allows these scores to be displayed. The scorecard also adds flexibility by allowing players to keep track of other golfing data.

BRIEF DESCRIPTION OF THE DRAWINGS

An embodiment of the present invention will now be described more fully with reference to the accompanying drawings in which.

DESCRIPTION OF THE PREFERRED EMBODIMENTS

Figure 1:
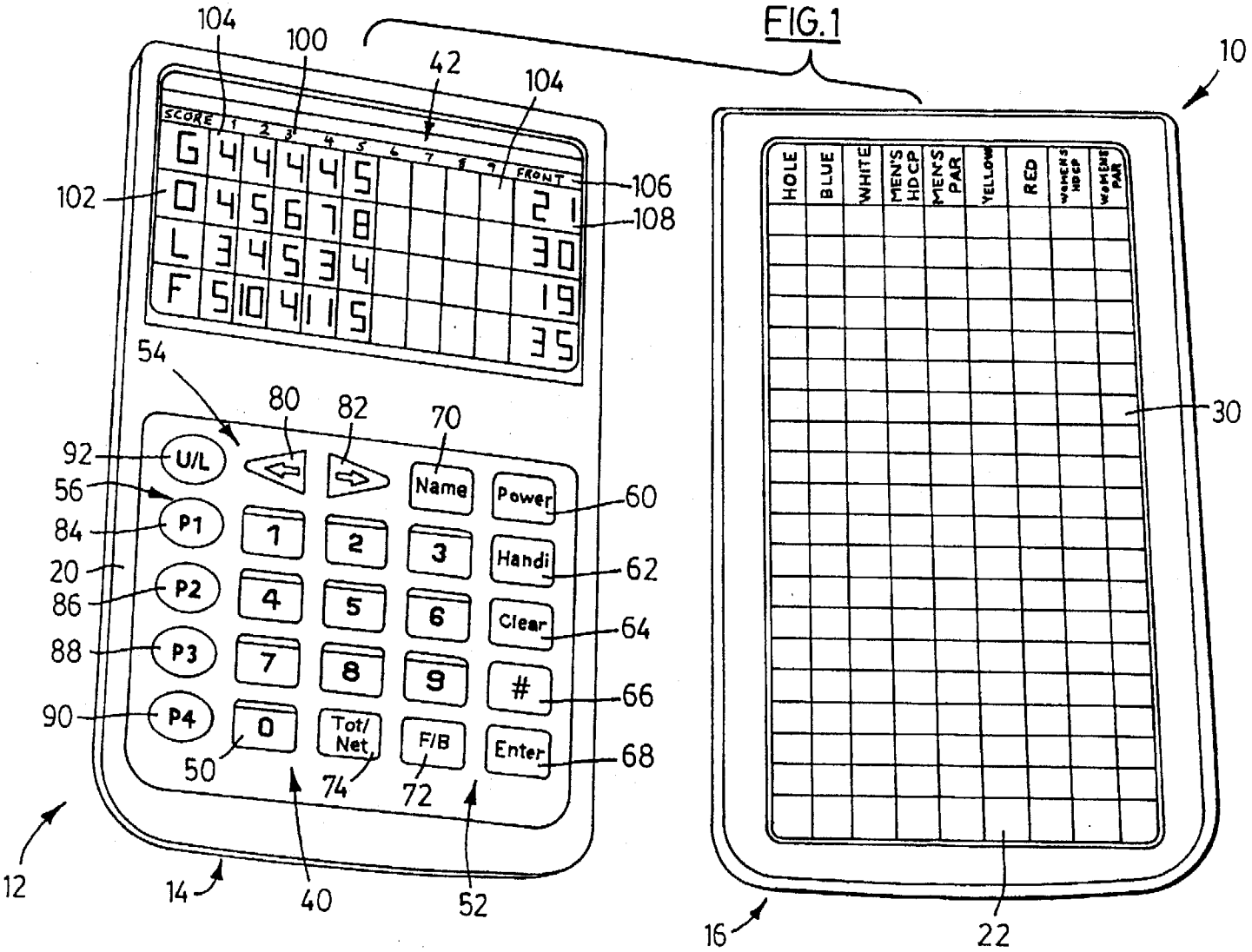
FIG. 1 is a perspective view of an electronic scorecard for the game of golf.

Referring to FIG. 1, an electronic golf scorecard is shown and is generally indicated by reference numeral 10. The scorecard is designed to keep score for one or more players during a game of golf. The scorecard 10 displays entries of the scores for either the entire front nine or back nine holes at a time and shows the cumulative gross score of each player for the nine holes of golf being displayed. The 18 hole cumulative gross score for each player is calculated after each entry and can be shown at any time. When eighteen holes of golf have been played, each player's net score is automatically calculated and can be displayed if each player's handicap data has been entered into the scorecard.

In the present embodiment, the scorecard 10 can keep score for up to eight players although it should be apparent that this number is arbitrary. When there are more than four players, only the scores for four players on either the front nine or back nine holes of golf can be displayed at a time. If there are fewer than eight players, the unused memory locations set aside for players' scores can be used to store other golfing data as will be described.

The scorecard 10 includes a casing 12 constituted by a main body 14 and a cover 16. The main body 14 and cover 16 are slidable relative to one another from top to bottom and have mating ridges (not shown) along their side edges to facilitate this relative movement. To expose the interior faces 20, 22 of the main body 14 and cover 16 respectively, a user must slide the cover 16 relative to the main body 14 to remove the cover. Once removed, the cover 16 can slide over the back of the main body 14 for storage.

The casing 12 is formed of waterproof and weather resistant material allowing it to be used in virtually all conditions. The casing 12 is also dimensioned to fit conveniently and comfortably in a clothing pocket, a golfbag pocket or a golfcart scorecard holder. Thus, the scorecard 10 can be used as easily as a conventional paper scorecard.

On the interior face 22 of cover 16 is a laminated card 30 on which details concerning the golf course to be played are presented. These details include yardage values calculated from the various tees on the individual holes of the golf course, the par values of the individual holes as well as the men's and women's handicap values assigned to each of the individual holes. The card 30 is specially designed to fit on the interior face 22 of the cover although it should be apparent that a conventional golf course scorecard may be used and fitted to the cover 16. The card 30 is attached to the cover 16 via suitable fastening means such as hook and loop fabric or two-sided tape (not shown).

On the interior face 20 of main body 14 is a keypad 40 and above it, a liquid crystal display (LCD) 42. The keypad has a number of numeric keys 50 labelled "0 to 9" as well as a number of function keys. The function keys are divided into three groups 52, 54 and 56 with the keys in each group being identified by a specific colour. The keys in group 52 include an on/off key 60 labelled "Power", an enter handicap key 62 labelled "Handi", a clear key 64 labelled "Clear", a number of players key 66 labelled "#", a data entry key 68 labelled "Enter", a player identifier key 70 labelled "Name", a front nine/back nine display key 72 labelled "F/B" and a total score/net score display key 74 labelled "Tot/Net".

The keys in group 54 are cursor direction keys 80, 82 and are labelled with arrows "←" and "→" respectively. The keys in group 56 include four player select keys 84 to 90 labelled "P1 to P4" respectively as well as an upper and lower display key 92 labelled "U/L".

The display 42 is configured to show the scores for either the front nine holes or the back nine holes for up to four players at a time. Golf course hole number display locations 100 are provided along the top of the display 42 while player initial display locations 102 are provided along the left-hand side of the display. The display locations 104 below each of the hole number display locations 100 that are in line with each player initial display location 102 show that player's score on the various holes when entered. At the top right-hand corner of the display 42 is a front nine/back nine indicator display location 106. Below the indicator display location 106 are display locations 108 which show the cumulative score for each player on the nine holes that are currently being shown on the display 42.

In FIG. 1, hole numbers 1 to 9 and the front nine indicator "Front" are shown in the display locations 100 and 106 respectively. Each player's scores on the first five holes has been entered and are shown in the display locations 104 beneath hole numbers 1 to 5. The cumulative score for each player on the front nine holes is shown in display locations 108 beneath the indicator Front. If the F/B key 72 is pressed, the back nine holes (i.e. hole numbers 10 to 18), and the back nine indicator Back will appear in the display locations 100 and 106 respectively. In addition, any players' scores that have been entered for those holes will be shown in display locations 104. The cumulative score of each player for the back nine will also be shown in display locations 108 below the indicator Back. Subsequent presses of the F/B key 72 cause the display 42 to toggle back and forth between the front nine hole and back nine hole entries.

Figure 2:
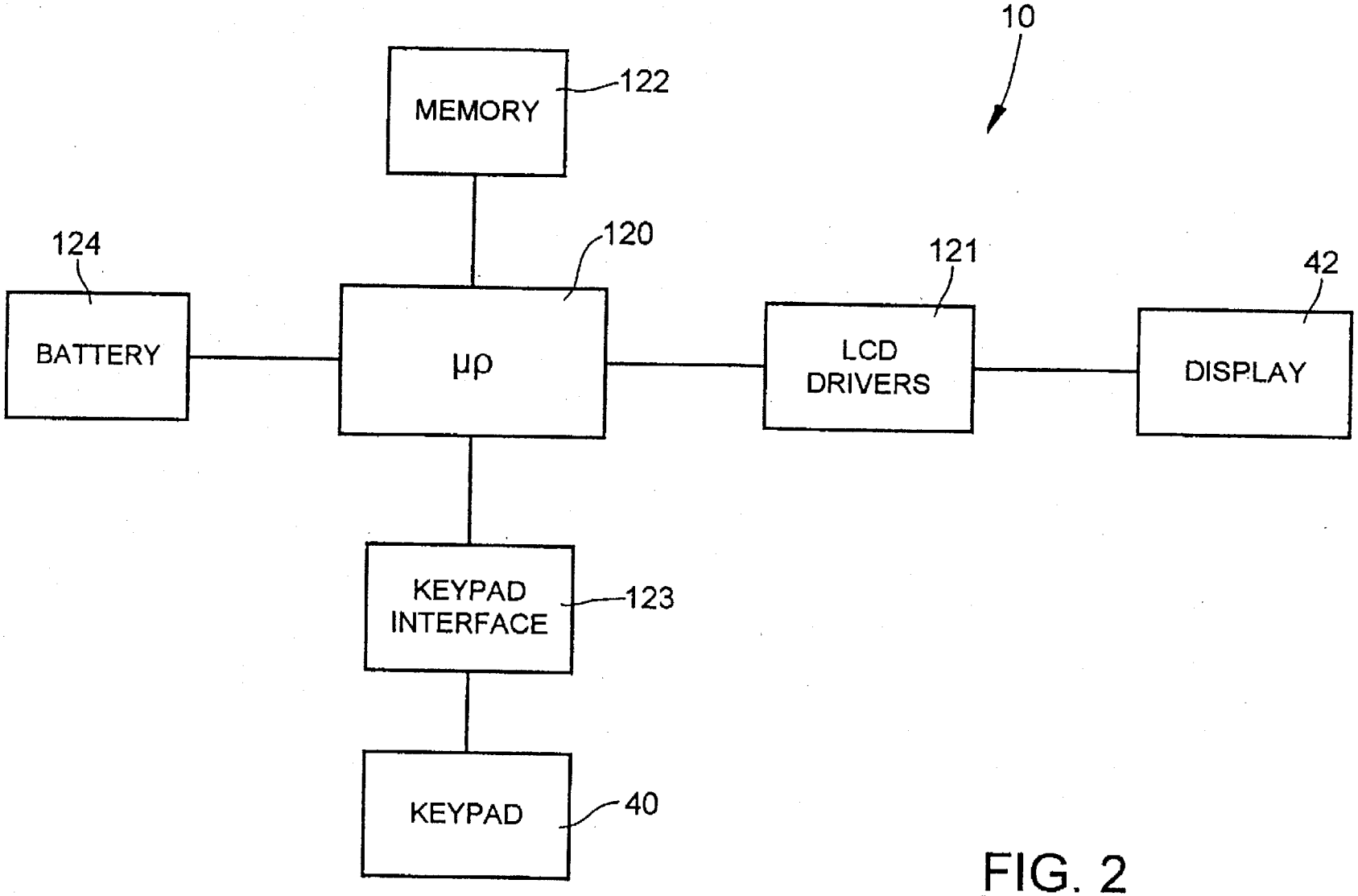
FIG. 2 is a schematic diagram of the electronic scorecard illustrated in FIG. 1.

Referring now to FIG. 2, a schematic diagram of the circuitry within golf scorecard 10 is shown. The scorecard 10 includes a processor in the form of a microprocessor 120 which communicates with both the keypad 40 and the display 42 via LCD display drivers 121 and keypad interfaces 123 respectively. The microprocessor 120 is also connected to ROM and RAM memory 122 as well as to a battery 124 which provides power to the scorecard 10. The ROM and RAM memory 122 is non-destructive so that all data stored therein is conserved if power loss occurs. The ROM and RAM memory 122 store pre-programmed operating data as well as data entered into the scorecard 10 via the keypad 40. The microprocessor 120 receives data as well as commands entered via the keypad 40 and processes both entered data and preprogrammed data depending on the entered commands. The results of the operations performed by the microprocessor 120 are shown on the display 42. To minimize power and conserve physical space, the ROM and RAM memory 122, the microprocessor 120, the LCD display drivers 121 and the keypad interfaces 123 are fabricated on a single Motorola 68MC05E1DW chip.

The general operation of the scorecard 10 will now be described. In use, the number of players and an initial of each player whose score is to be kept using the scorecard 10 is entered. The entered initial for each player is displayed along the left-hand side of the display 42 in display locations 102. If net score calculations are desired, each player's index number and the course slope rating of the golf course to be played, are entered into the scorecard 10. The scorecard automatically calculates each player's handicap, for that golf course, from this information and automatically subtracts the handicap from the player's gross score when eighteen holes of golf have been played to calculate automatically each player's net score.

The scores for each player are entered as the holes of golf are played. The display 42 shows the entered scores for either the front nine or back nine holes at a time, as well as the cumulative scores on the displayed nine holes. The scorecard 10 also keeps a running total of each player's 18 hole cumulative score. These 18 hole cumulative scores can be displayed at any time by pressing the Tot/Net key 74. When one of the nine holes has been completed, the F/B key 72 must be pressed to condition the display 42 to show the other nine holes.

If there are fewer than eight players, the display locations set aside for these additional players can be used to keep track of other golfing data such as the holes won or lost in the match by each player, the stroke holes in the match, the number of putts each player takes per hole or other golfing data relating to any snip game the players wish to play.

Further details of the operation of the scorecard 10 including the key sequences that need to be pressed to achieve the above functionality will now be described.

Power

Once the Power key 60 is pressed to turn the scorecard 10 on, it remains on as long as another key is pressed at least every 60 seconds. If no key is pressed within 60 seconds, the scorecard 10 automatically shuts itself off to preserve power while ensuring that all entered and calculated data remains preserved in the memory 122. When the scorecard 10 is turned back on, the data is retrieved from the memory 122 and is displayed exactly as it was before the scorecard was turned off or turned itself off.

Set-up

As soon as the scorecard 10 is powered up, the stored and calculated data for the previous round of golf is retrieved from the memory 122 and displayed. If a new game of golf is being played, the memory contents need to be cleared. To clear the memory 122, the key sequence, Clear key 64, Enter key 68, Clear key 64, must be entered. As soon as this key sequence is pressed, all previously entered scores that were stored in the memory 120 are erased. The players' initials as displayed during the previous game remain displayed and can be changed if desired as will be described. Once the previous scores have been erased, the display 42 is set to show the front nine holes in display locations 100, the number of players is reset to a default number (in this case four) and the cursor moves to the display location 104 below hole number 1 in line with the initial display location 102 for player P1.

If the number of players is greater or fewer than four, the user must press the key sequence, # key 66, appropriate numeric key 50, Enter key 68 to establish the number of players in the group. After the number of players has been entered, the # key 66 can be pressed again to return the scorecard 10 to its previous mode of operation or another function key can be pressed to condition the scorecard to a different mode of operation.

Once the number of players has been established, the initial of each player can be changed from that already displayed. To change a player's initial, the user must press the Name key 70. When the Name key 70 is pressed, the cursor flashes at the first player initial display location 102. The user can press or hold one of the two arrow keys 80, 82 to cycle up and down through the alphabet. Once the appropriate initial is located at the first player initial display location 102, the Enter key 68 needs to be pressed to save and display this data. After this has been done, the cursor moves automatically to the next player initial display location 102 so that the above steps can be repeated. If it is desired to enter the players' initials out of sequence, the Name key 70 and then the appropriate player P1 to P4 select key 84 to 90 must be pressed to position the cursor at the appropriate player initial display location 102. The user can press or hold one of the two arrow keys 80, 82 to cycle up and down through the alphabet. Once all of the player initials have been entered, the Name key 70 can be pressed to return the scorecard 10 to its previous mode of operation or another function key can be pressed to condition the scorecard to a different mode of operation.

After the initial for each of the players is as desired, the handicap for each of the players can be entered. To achieve this, the Handi key 62 must be pressed. Once this is done, the scorecard 10 using the display, prompts the user to enter the three-digit slope rating assigned to the golf course to be played using the appropriate numeric keys 50. Once entered, the Enter key 68 is pressed to store the course slope rating for all of the players in the memory 122. The stored course slope rating is then displayed for each player.

After the course slope ratings are displayed for each player, the cursor flashes at the first player position and the user is prompted to enter the three-digit index number for the first player. Once the three-digit index number for the first player has been entered via the numeric keys 50, the Enter key 68 must be pressed. Following this, the microprocessor 120 automatically calculates the player's handicap by multiplying the course slope rating by the player's index number, dividing the product by 113 and rounding the result to the nearest whole number. The handicap for the first player is then displayed. Following this, the cursor automatically flashes at the second player position and the user is prompted to enter the second player's three-digit index number. This process is repeated until each of the player's handicaps has been calculated.

If necessary, the course slope rating entry for one or more players can be changed, once it has been established in the manner described above. This would be necessary if individuals in the same group were playing from different tees. To change a course slope rating for a player, the appropriate player Pi to P4 select key 84 to 90 must be pressed to position the cursor in line with that players course slope rating. The right arrow key 82 then must be pressed to move the cursor from the index number display location to the displayed course slope rating for that player. The displayed course slope rating will then flash and the correct course slope rating for that player can then be entered via the appropriate numeric keys 50. Once entered, the Enter key 68 must be pressed to store the correct course slope rating for that player. As soon as this has been done, the corrected handicap for that player is automatically calculated and displayed and the cursor moves to the next available index display location. The above steps must be performed if the course slope rating is to changed for another player.

Figure 3:
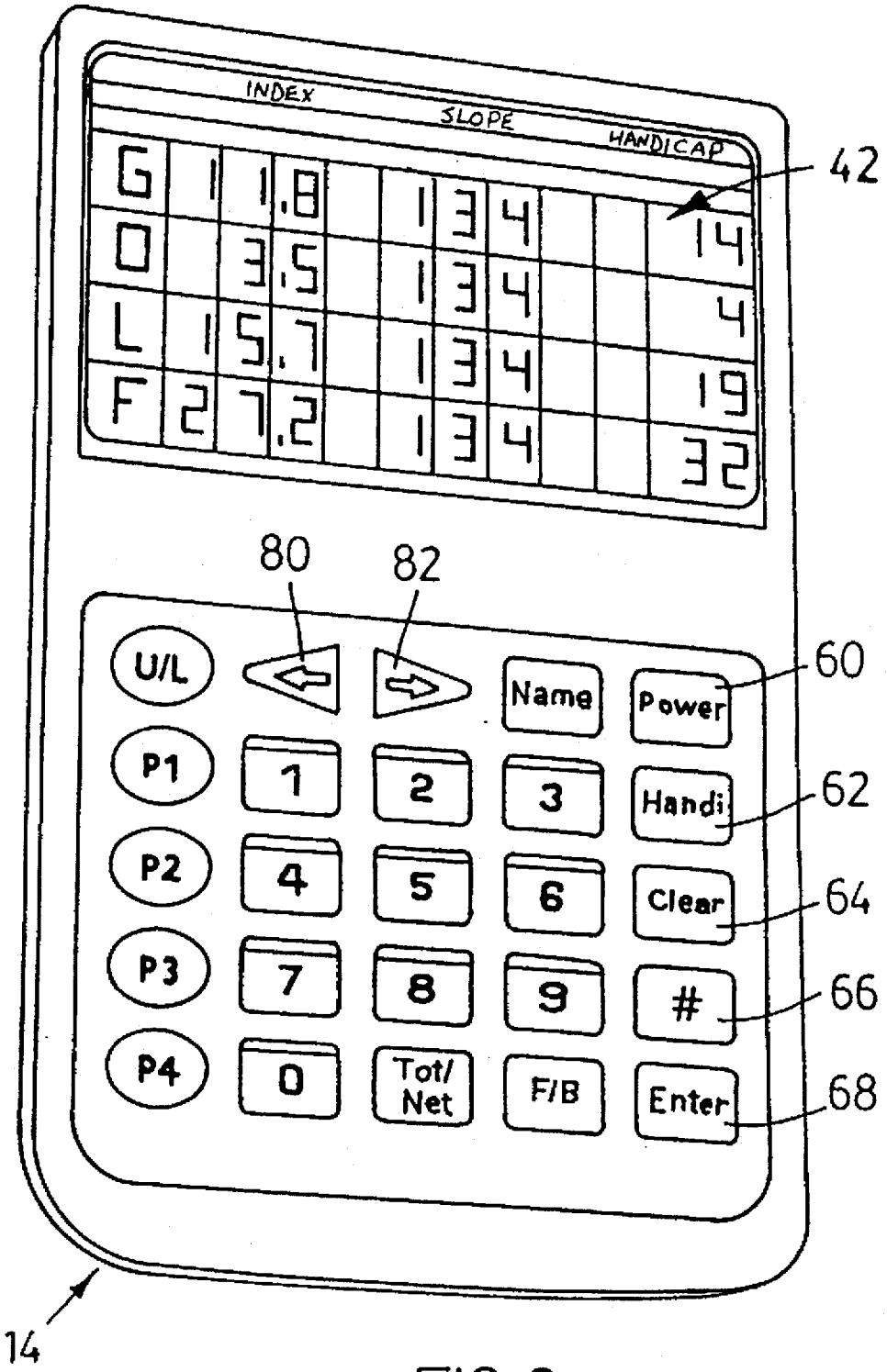
FIG. 3 is a top plan view of a portion of the electronic scorecard shown in FIG. 1.

FIG. 3 shows the display 42 after the Handi key 62 has been pressed, the course slope and player index numbers entered, and the player's handicaps automatically calculated.

After all of these steps have been completed, the set-up for the scorecard 10 is complete and the scorecard can be used to keep score for each of the players in the group playing the game.

Game Play

After set-up and assuming that the memory 122 has been cleared, the cursor flashes at the display location 104 for the first player beneath the hole 1 display location 100. When the first hole has been played out by each of the players, the first player's score is entered by pressing the appropriate numeric key 50 and then the Enter key 68. This key sequence results in the score for the first player being stored in memory 122 and shown on the display 42 in the appropriate display location 104. Once this had been done, the cursor automatically moves to the display location 104 beneath hole 1 for the next player. The above key sequence is then repeated until each player's score for hole 1 has been entered at which time, the cursor automatically moves to the display location 104 beneath hole number 2 for player 1. Thus, the typical entry sequence for players' scores is player 1 to n, holes 1 to 9 and holes 10 to 18 with the cursor automatically moving to the next entry in the sequence after an entry has been made.

If a player's score needs to be entered out of sequence, the appropriate player P1 to P4 select key 84 to 90 is pressed. When this is done, the cursor automatically moves to the next available display location 104 for that player. The numeric key 50 signifying the player's score can then be pressed followed by the Enter Key 68. Once the Enter Key has been pressed, the cursor automatically moves back to the previous available display location 104 in the above-mentioned typical entry sequence.

If at some time, it is necessary to correct an entry for a player, the appropriate player P1 to P4 select key 84 to 90 needs to be pressed to position the cursor at the appropriate player's row of scores and then the arrow keys 80 and 82 must be used to move the cursor to the score which needs to be changed. Once the cursor is properly positioned, the previous incorrect score entry flashes. The correct score can then be entered by pressing the appropriate numeric keys 50 and then the Enter key 68. Again, once the Enter key 68 has been, the cursor automatically moves back to the next available display location 104 in the typical entry sequence.

As the players' scores are entered and displayed in display locations 104, the microprocessor automatically calculates the cumulative score for each player based on the displayed entries. These cumulative scores are displayed below indicator display location 106 in display locations 108. The microprocessor 120 also calculates the total 18 hole cumulative score for each player. These 18 hole cumulative scores can be displayed at any time by pressing the Tot/Net key 74.

Once scores on the first nine holes for all players have been entered, the F/B key 74 must be depressed to toggle the display 42 to show the back nine holes 10 to 18 in display locations 100 as well as the indicator Back in display location 106. Again, as players' scores are entered in display locations 104, the cumulative score for each player on the displayed holes is calculated and displayed in display locations 108 below indicator display location 106.

If the game of golf to be played starts at a hole other than the first hole, which occurs during shotgun play, the scores for the starting hole must be entered manually by pressing the appropriate player P1 to P4 select key 84 to 90 and then moving the cursor to the proper display location 104 using the arrow keys 80 and 82. Once the scores for all of the players for that hole have been entered, the cursor is automatically positioned at the display location 104 in line with player 1 for the next hole. All future score entries will follow in sequence until all 18 holes of golf have been played.

At any time during game play, if the Tot/Net key 74 is pressed, the current 18 hole cumulative score of each player which has been accumulatively calculated by the microprocessor 120, is displayed.

Also, if the user wants to toggle between a display of the front nine and back nine holes, the F/B key 72 simply needs to be pressed.

Once the scores on all eighteen holes for each of the players have been entered, each player's net score is automatically calculated by the microprocessor 120 by subtracting each player's handicap from that player's gross score. If the Tot/Net key 74 is pressed, the cumulative gross score as previously calculated for all of the players, is displayed. If the Tot/Net key 74 is pressed once again, the microprocessor displays the players' net scores. Further presses of the Tot/Net key 74 will toggle the display 42 between a display of the players' gross and net scores.

If more than four players exist, the scorecard 10 automatically toggles to the display for additional players P5 to P8 once the scores for players P1 to P4 have been entered. When the scores for players P5 to P8 have been entered, the scorecard 10 automatically toggles the display 42 to show the scores for players P1 to P4. If a score for one of players P5 to P8 needs to be entered out of turn, or if it is desired to visualize the scores for players P5 to P8, the U/L key 92 must be pressed to toggle the display to show these players' scores.

If less than eight players are in the group, the memory locations set aside for the additional players may be used to keep track of snip game entries. For example, these memory locations may be used to keep track of the number of putts taken by each player on each hole. Alternatively, handicap holes may be marked at the appropriate locations for the various players or the holes won or lost by each of the players may be entered. Other golfing data may be stored in these locations such as the course handicap rating for each hole, the player with the honor on each hole, the number of greens or fairways hit in regulation, the number of sand shots taken on each hole, the amount of money won or lost on each hole, the presses or new bets made, the par values for each hole, the number of strokes over or under par, the number of lost balls or the number of penalty strokes taken. In fact, these unused memory locations may be used to hold any desired golfing data. These memory locations are accessed by pressing the U/L key 92 and selecting the appropriate player P1 to P4 select key 84 to 90 to position the cursor at the desired display location 104. Once the cursor is properly positioned, the appropriate numeric key 50 and the Enter key 68 need to be pressed to store the desired golfing data in memory.

Although the preferred embodiment of the scorecard has been described as being able to keep score for up to eight players, it should be apparant to those of skill in the art that this number is arbitrary and that the scorecard can be designed to keep score for basically any number of players. Also, it should be realized by those of skill in the art that the scorecard can be modified to store the scores for more than one previous game of golf and allow the stored scores for these games of golf to be retrieved from memory and reviewed visually and/or deleted from memory as desired. Specifically, it is contemplated that the scorecard 10 can store the golf scores for at least one player over an entire season.

Although not shown, a serial port may also be provided on the scorecard 10 to allow data stored in the memory to be downloaded into a computer. Thus, in the case of a public, semi-private or private golf courses, different member using the scorecard 10 can download data from their scorecard into a common computer allowing golf scores and handicaps for a number of members to be stored collectively.

Although the circuitry within the scorecard 10 has been described as being formed on a single chip, it should be realized that discrete components can be used if desired. Also, although the scorecard 10 has been described as calculating players' handicaps using the course slope rating and players' index numbers, it should be realized that the scorecard can also be programmed to allow players to enter their handicaps directly which can then be used to calculate net scores.

It should also be apparent to those of skill in the art that other functionality can be incorporated in the scorecard without departing from the scope of the present invention.

We claim:

1. An electronic scorecard for the game of golf to keep score for at least one player comprising:

a portable housing;

memory within said housing;

a keypad on said scorecard allowing a user to enter golfer scoring data and golfer handicap data for storage in said memory, said keypad also allowing a user to input selected commands;

a processor responsive to keypad input, said processor calculating a running gross score of said at least one player for a game of golf based on said entered golfer scoring data and calculating a net score of said at least one player upon completion of said game of golf based on said gross score and said handicap data, said gross and net scores also being stored in said memory;

a display presenting said golfer scoring data for each hole on either a front nine or back nine holes of golf and toggling between a display of said golfer scoring data for said front nine and for said back nine holes of golf in response to keypad input, said display also displaying said gross score and said net score of said at least one player; and a power supply for powering said electronic scorecard.

2. An electronic scorecard as defined in claim 1 wherein said net score of said at least one player is displayed in response to a selected command entered via said keypad.

3. An electronic scorecard as defined in claim 2 wherein said golfer handicap data is determined from an index number of said at least one player and a golf course slope rating, said keypad allowing entry of said index number and golf course slope rating for storage in said memory, said processing means calculating said golf handicap data based on said entered index number and golf course slope rating.

4. An electronic scorecard as defined in claim 1 wherein said display presents golfer scoring data and running gross scores for at least four players.

5. An electronic scorecard as defined in claim 4 wherein said keypad allows a user to enter at least one initial of each player for storage in said memory, said display presenting each said at least one initial.

6. An electronic scorecard as defined in claim 1 wherein said keypad allows a user to enter other desired player determined golfing data associated with said at least one player, said entered other player determined golfing data being stored in said memory and being presented on said display in response to input selected commands.

7. An electronic scorecard as defined in claim 6 wherein said other desired player determined golfing data is selected from the group consisting of putts per hole, holes won or lost in a match, stroke holes in a match, course handicap ratings, player with the honor on each hole, greens or fairways hit in regulation, sand shots, money won or lost on each hole, presses or new bets made, par values for each hole, strokes over or under par, lost balls or penalty strokes taken.

8. An electronic scorecard as defined in claim 1 wherein said memory retains all data stored therein when power to said scorecard is shut off.

9. An electronic scorecard as defined in claim 1 wherein said processor conditions said display to prompt said at least one player to enter golfer scoring data in a sequential manner.

10. An electronic scorecard as defined in claim 9 wherein said keypad allows a user to enter golfer scoring data out of sequence, said processor conditioning said display to prompt said at least one player to enter remaining golfer scoring data in said sequential manner after golfer scoring data has been entered out of sequence.

11. An electronic scorecard for the game of golf to keep score for at least one player comprising:

a portable housing;

a keypad on said housing, said keypad including player keys allowing a user to select the number of players for whom data is to be kept and to whom golfer scoring data applies; numeric keys allowing a user to enter golfer scoring data for each selected player together with other player selected golfer data representing an aspect of a game of said selected player to be monitored during a game of golf and a handicap key allowing a user to enter handicap data for each selected player via said numeric keys;

memory within said housing storing said golfer scoring data, said other entered player selected golfer data and said handicap data;

a processor responsive to said keypad, said processor calculating a running gross score for each said selected player during a game of golf based on said entered golfer scoring data, said processing means calculating a net score for each said selected player based on said handicap data and said gross scores after entry of golfer scoring data for a complete game of golf;

a display presenting said golfer scoring data or said other entered player selected golfer data for each hole on either a front nine or a back nine holes of golf, said display toggling between a display of said front nine or said back me holes of golf in response to a selected command input via a display select key of said keypad to present visually an historical performance of each said selected player's gross score or the aspect of said selected player's game being monitored as represented by said other entered player selected golfer data over nine holes of golf; and a power supply for powering said electronic scorecard.

12. An electronic scorecard as defined in claim 11 wherein said other player selected golfer data is selected from the group consisting of putts per hole, holes won or lost in a match, stroke holes in a match, course handicap ratings, player with the honor on each hole, greens or fairways hit in regulation, sand shots, money won or lost on each hole, presses or new bets made, par values for each hole, strokes over or under par, lost balls or penalty strokes taken.

13. An electronic scorecard as defined in claim 11 wherein said handicap data includes a course slope rating and an index number.

14. An electronic scorecard for the game of golf to keep score for at least one player comprising:

a portable housing;

memory within said housing;

input means on said scorecard allowing a user to enter golfer scoring data, golfer index data and golf course slope data for storage in said memory, said input means also allowing a user to input selected commands;

a processor responsive to said input means, said processor calculating a running gross score of said at least one player for a game of golf based on said entered golfer scoring data, said processing means also calculating golfer handicap data based on said golfer index data and said golf course slope data and calculating a net score of said at least one player upon completion of said game of golf based on said gross score and said golfer handicap data, said gross and net scores also being stored in said memory;

a display presenting said golfer scoring data and said gross and net scores; and a power supply powering said electronic scorecard, said power supply including automatic shut-off means to turn said electronic scorecard off after a predetermined amount of time has elapsed without use of said input means.

* * * * *